US007874692B2

(12) United States Patent
Zheng et al.

(10) Patent No.: US 7,874,692 B2
(45) Date of Patent: Jan. 25, 2011

(54) LED LAMP

(75) Inventors: Dong-Bo Zheng, Shenzhen (CN); Meng Fu, Shenzhen (CN); Chun-Chi Chen, Taipei Hsien (TW)

(73) Assignees: Fu Zhun Precision Industry (Shen Zhen) Co., Ltd., Shenzhen, Guangdong Province (CN); Foxconn Technology Co., Ltd., Tucheng, Taipei County (TW)

( * ) Notice: Subject to any disclaimer, the term of this patent is extended or adjusted under 35 U.S.C. 154(b) by 378 days.

(21) Appl. No.: 12/134,163

(22) Filed: Jun. 5, 2008

(65) Prior Publication Data

US 2009/0303718 A1 Dec. 10, 2009

(51) Int. Cl.
*A45B 3/02* (2006.01)

(52) U.S. Cl. ..... 362/102; 362/253; 362/294; 362/373; 362/800; 135/16

(58) Field of Classification Search ..... 362/102, 362/253, 294, 373, 800; 135/16, 98, 901
See application file for complete search history.

(56) References Cited

U.S. PATENT DOCUMENTS 6,840,657 B2 * 1/2005 Tung ..... 362/352
6,966,667 B2 * 11/2005 Li ..... 362/102
2006/0070642 A1 * 4/2006 Lo ..... 135/16

* cited by examiner

*Primary Examiner*—Sandra L O Shea
*Assistant Examiner*—Meghan K Dunwiddie
(74) *Attorney, Agent, or Firm*—Frank R. Niranjan

(57) ABSTRACT

An LED lamp includes a lamp cover consisting of a plurality of sector-shaped connecting bodies, a plurality of fins attached to the lamp cover and a plurality of LED modules attached to the lamp cover and opposing the fins. A locking device is pivotably mounted to the lamp cover and comprises a supporting pole extending in the lamp cover, a plurality of branches pivotably mounted to the lamp cover and the supporting pole. The branches are movable along the supporting pole to be locked at a desired position, whereby an illumination angle of the LED modules of the lamp cover relative to the supporting pole is changeable via movement of the branches along the supporting pole of the locking device. Thus, an illumination area and an illumination intensity of the LED lamp are adjustable.

11 Claims, 3 Drawing Sheets

LED LAMP

BACKGROUND OF THE INVENTION

1. Field of the Invention

The present invention relates to an LED lamp, and particularly to an LED lamp which can satisfy a large-region illumination requirement and a high-brightness requirement. In addition, an illumination area and an illumination intensity of the LED lamp are adjustable.

2. Description of Related Art

With the continuing development of scientific technology, light emitting diodes have been widely used in the illumination field due to their high brightness, long life-span, and wide color gamut.

An LED lamp is a type of solid-state lighting device that utilizes light-emitting diodes (LEDs) as a source of illumination.

Presently, a conventional LED lamp generally comprises a lamp cover and a plurality of LEDs attached to an inner wall of the lamp cover. However, once assembled, an illumination area of light emitted by the LEDs of the conventional LED lamp is restricted to a fixed value along a direction of the LED lamp. A problem is generated that the conventional LED lamp fails to provide an adjustable illumination area and illumination intensity of the light emitted by the LEDs. So the conventional LED lamp cannot satisfy a requirement that an illumination area and an illumination intensity of the LED lamp are variable, which may be required for some applications.

What is needed, therefore, is an LED lamp which can overcome the above-mentioned disadvantages.

SUMMARY OF THE INVENTION

The present invention relates to an LED lamp. According to a preferred embodiment of the present invention, the LED lamp includes a lamp cover, a plurality of fins attached to the lamp cover and a plurality of LED modules attached to the lamp cover and opposing the fins. A locking device is pivotably mounted to the lamp cover and comprises a supporting pole extending in the lamp cover and a plurality of branches pivotably mounted to the lamp cover and the supporting pole. The branches have lower ends movable along the supporting pole to be fixed at a desired position. Uppers end of the branches are pivotably attached to the lamp cover. The lamp cover consists of a plurality of sector-shaped connecting bodies. An illumination angle of the LED modules of the lamp cover relative to the supporting pole is changeable via a movement of the branches along the supporting pole of the locking device, thereby to adjust an illumination area and illumination intensity of the LED lamp.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
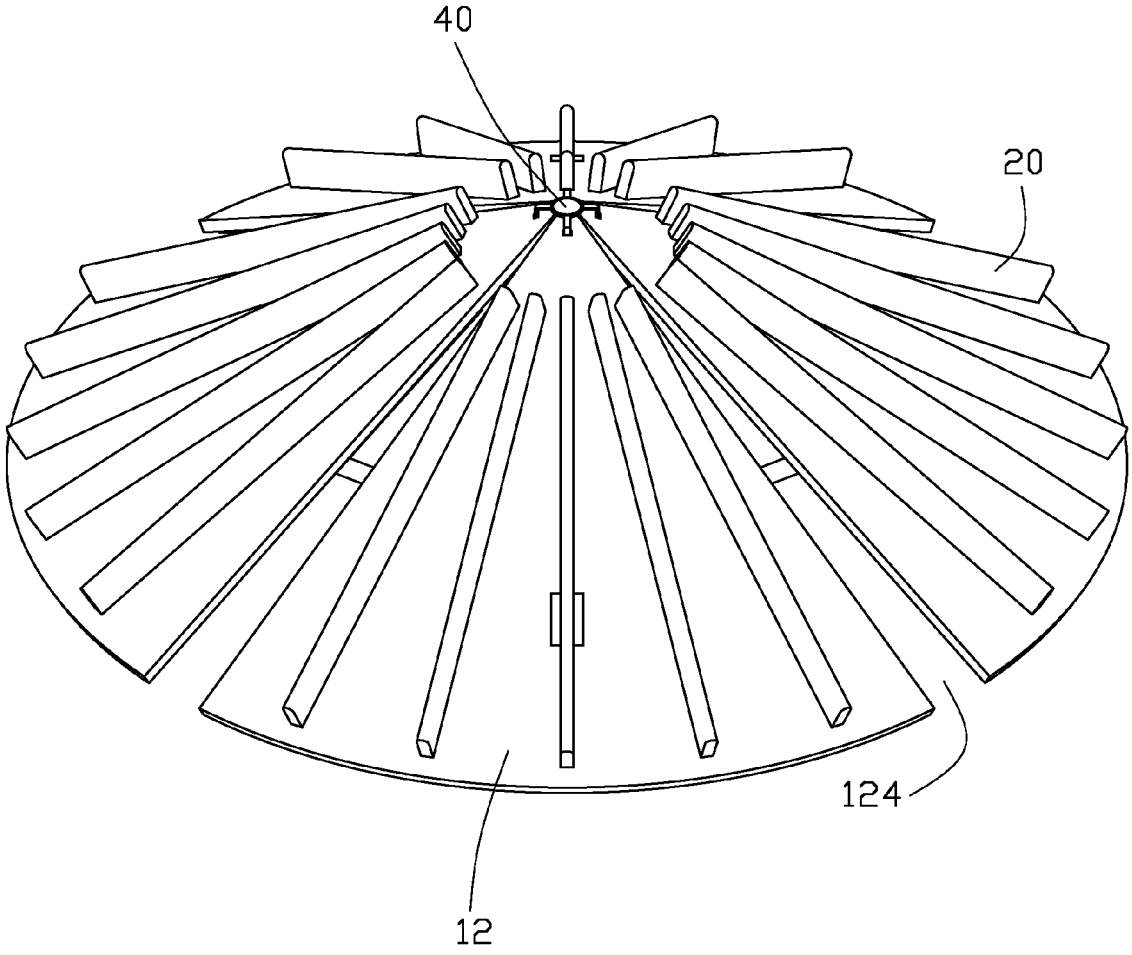
FIG. 1 is an isometric, assembled view of an LED lamp in accordance with a preferred embodiment of the present invention.
Figure 2:
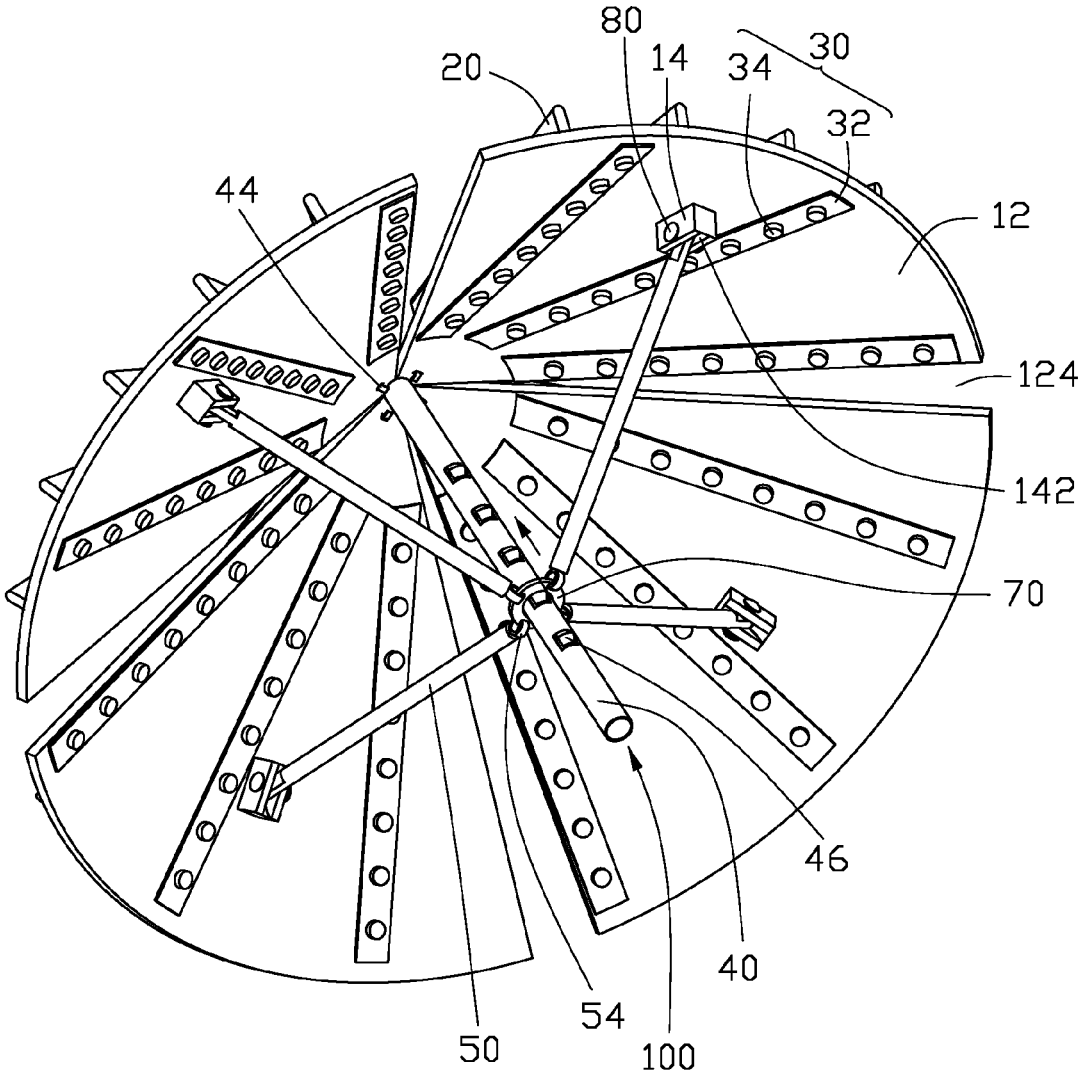
FIG. 2 is an isometric, assembled view of FIG. 1, but shown from another aspect.

FIG. 1 illustrates an LED lamp in accordance with a preferred embodiment of the present invention, which comprises a lamp cover 10, a plurality of fins 20 attached on an outer sidewall of the lamp cover 10, a plurality of LED modules 30 attached to an inner sidewall of the lamp cover 10 and a locking device 100 pivotably connected to an inside of the lamp cover 10 for adjusting an illumination area and an illumination intensity of the LED modules 30.

The lamp cover 10 comprises a plurality of connecting bodies 12. Each connecting body 12 is substantially sector-shaped and defines an engaging hole 120 at a location adjacent to a top apex thereof. A pivot portion 14 is formed on the inner sidewall of each connecting body 12, located at a median of the each connecting body 12 through the top apex and spacing from the top apex a distance about two-third of a length of the median. The pivot portion 14 defines a pair of pivot holes 140 in two opposite sidewalls thereof for receiving a pivot 80 to connect the locking device 100 to the lamp cover 10. A receiving slot 142 is defined in a center of the pivot portion 14. A circular through hole 122 is cooperatively defined in the top apexes of the connecting bodies 12 for receiving a top end of the locking device 100 therein. A cutout 124 is defined between every two adjacent connecting bodies 12 such that a distance between the two adjacent connecting bodies 12 is adjustable when the locking device 100 is operated to move the lamp cover 10.

The fins 20 extend radially and outwardly from the outer sidewall of the lamp cover 10. The fins 20 are identical to each other and centrosymmetric relative to a central axis of the lamp cover 10.

Figure 3:
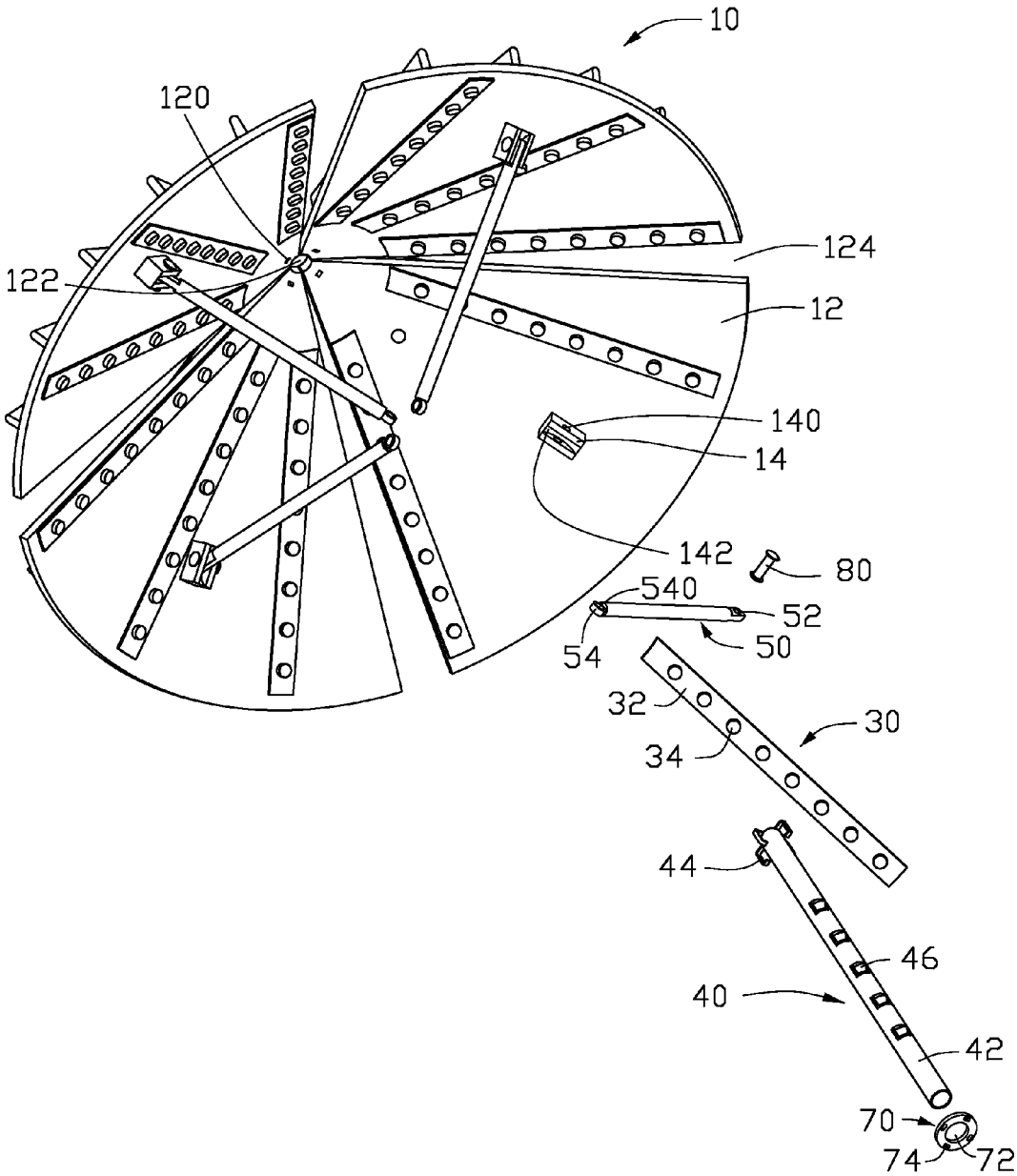
FIG. 3 is a partly exploded view of the LED lamp of FIG. 2.

As shown in FIG. 3, the locking device 100 comprises a supporting pole 40 holding the lamp cover 10 on a top thereof, a plurality of branches 50 each pivotably connected to a corresponding pivot portion 14 of the lamp cover 10 and a ring 70 connecting the branches 50 to the supporting pole 40. The supporting pole 40 comprises an elongated cylinder 42, a plurality of hooks 44 extending outwardly and radially from a top of the cylinder 42 and a plurality of tabs 46 extending outwardly and vertically from the cylinder 42 along a length of the cylinder 42. The hooks 44 are identical to each other and centrosymmetric relative to the central axis of the cylinder 42. Furthermore, the hooks 44 are corresponding to the engaging holes 120 in the connecting bodies 12 of the lamp cover 10. The tabs 46 are arranged in a line and are resiliently moveably received in an inside of the cylinder 42 of the supporting pole 40, whereby the tabs 46 can regain their original positions after a depressing acting thereon is released. Each branch 50 has a pole (not labeled) and comprises a pair of clasps 54 at a lower end portion of the pole for grasping the ring 70 together. Each pair of clasps 54 defines a connecting hole 540 therein. The ring 70 defines a circular central hole 72 in a centre thereof and a plurality of intersecting apertures 74 around the circular central hole 72 for engagingly receiving the clasps 54 of the branches 50. The intersecting apertures 74 are identical to each other and centrosymmetric relative to the central hole 72.

The LED modules 30 each comprise an elongated printed circuit board 32 with a size substantially identical to that of the length of the connecting body 12 of the lamp cover 10. A plurality of LED components 34 is mounted in a line on each of the printed circuit boards 32 along a length of the printed circuit board 32.

In assembly of the LED lamp, the top end of the cylinder 42 of the supporting pole 40 extends in the through hole 122 of the lamp cover 10. The central hole 72 of the ring 70 is brought to extend over the cylinder 42 of the of supporting pole 40 from a bottom end thereof until the ring 70 passes over at least one of the tabs 46 so that the ring 70 is attached to the cylinder 42. The hooks 44 of the supporting pole 40 extend in the engaging holes 120 and clasp top portions of the connecting bodies 12 of the lamp cover 10, whereby the top portions of the connecting bodies 12 are pivotably connect to the top end of the cylinder 42. The branches 50 each have an ear 52 at an upper end portion of the pole thereof. The ear 52 is pivotablly connected to a corresponding pivot portion 14 of the lamp cover 10 via a pivot 80 extending in the pivot holes 140 of the pivot portion 14 and the ear 52, in which the ear 52 is received in the receiving slot 142 of the pivot portion 14. The clasps 54 at the lower end portion of each branch 50 engage with the ring 70 via the clasps 54 clipping in a corresponding intersecting aperture 74 of the ring 70. The two opposite upper and lower end portions of each branch 50 are pivotablly connected to the corresponding pivot portion 14 and the supporting pole 40.

In use of the LED lamp, when the LED lamp is demanded to provide a large illumination area, under upward force acting on the ring 70, the ring 70 with the lower end portions of the branches 50 is moved upwardly along the length direction of the supporting pole 40. At a certain position, a corresponding tab 46 of the supporting pole 40 is depressed by the ring 70 and received in the inside of the supporting pole 40. When the depressing force is removed as the ring moves through the corresponding tab 46 at the certain position, the corresponding tab 46 regains its original position to project outwardly from the supporting pole 40 and hold the ring 70 thereon at a required position, whereby the locking device 100 is secured at the required position, the angle of each of the connecting bodies 12 of the lamp cover 10 relative to the supporting pole 40 becomes larger than before and a distance between every two adjacent connecting bodies 12 of the lamp cover 10 is decreased. At this time, an illumination area of light emitted by the LED components 34 attached to the inner sidewall of the lamp cover 10 becomes larger than before so that the LED lamp can provide a large illumination area. At this expanded position of the lamp cover 10, the illumination intensity generated by the LED lamp is lessened. When a downward force is brought to act on the ring 70, the ring 70 with the lower end portions of the branches 50 is moved downwardly along the length direction of the supporting pole 40. At a certain position, a corresponding tab 46 of the supporting pole 40 is depressed by the ring 70 and received in the inside of the supporting pole 40. When the depressing force is removed, the corresponding tab 46 regains its original position to project outwardly from the supporting pole 40. The ring 70 is held at a desired position by an adjacent lower tab 46 of the corresponding tab 46. Thus, the locking device 100 is secured at the desired position, the angle of each of the connecting bodies 12 of the lamp cover 10 relative to the supporting pole 40 becomes smaller than before and the distance between every two adjacent connecting bodies 12 of the lamp cover 10 is decreased. At this time, the illumination area of light emitted by the LED components 34 attached to the inner sidewall of the lamp cover 10 becomes smaller than before so that the LED lamp can provide an illumination with a higher intensity at the smaller area. Accordingly, an angle of each connecting body 12 of the lamp cover 10 relative to the supporting pole 40 is adjustable via movement of the ring 70 along a length direction of the supporting pole 40. The illumination area and intensity of light emitted by the LED components 34 attached to the inner sidewall of the lamp cover 10 can be changed via adjusting the angle of the branches 50 relative to the supporting pole 40.

Since adjustment of the illumination area and illumination intensity of the light emitted by the LED components 34 can be achieved via adjusting the illumination angle of light emitted by the LED components 34 of the lamp cover 10 relative to the supporting pole 40 of the locking device 100, the problem of the conventional LED lamp which has a fixed illumination area and a fixed illumination intensity can be overcome by the arrangement of the locking device 100 located at the inside of the LED lamp in accordance with the present invention.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp, comprising:

a lamp cover comprising a plurality of fins attached to an outer sidewall thereof and a plurality of LED modules attached to an inner sidewall thereof; and a locking device pivotably connected to an inside of the lamp cover, the locking device comprising a supporting pole extending in the lamp cover and a plurality of branches pivotably connected to the supporting pole and the lamp cover;

wherein each of the branches of the locking device is supported by the supporting pole when the locking device is moved to a locked position and wherein the branches of the locking device can be moved along the supporting pole to be held at a desired position, so that an illumination angle of the LED modules of the lamp cover relative to the supporting pole is changeable via movement of the branches along the supporting pole of the locking device to thereby adjust an illumination area and an illumination intensity of the LED lamp;

wherein the lamp cover comprises a plurality of sector-shaped bodies each having one end portion connecting with each other and the bodies are pivotably connected to the supporting pole, and wherein a distance between every two adjacent bodies is changeable when the branches move along the supporting pole;

wherein the locking device further comprises a ring connecting the branches and the supporting pole and the ring is movable along a length direction of the supporting pole whereby the branches are moved along the supporting pole; and wherein the supporting pole comprises a plurality of tabs extending therefrom and the ring is supported by a corresponding tab when the locking device is moved to the desired position.

2. The LED lamp as claimed in claim 1, wherein the lamp cover comprises a plurality of pivot portions located at the inner sidewall thereof and an upper end portion of each branch is pivotably connected to a corresponding pivot portion.

3. The LED lamp as claimed in claim 2, wherein each branch comprises a pair of clasps at a lower end portion thereof and the clasps of the branch engage with the ring.

4. The LED lamp as claimed in claim 2, wherein the ring defines a central hole in a center thereof and a plurality of intersecting apertures around the central hole, the supporting pole being extended in the central hole of the ring and the clasps of each branch engaging with a corresponding intersecting aperture of the ring.

5. The LED lamp as claimed in claim 2, wherein each pivot portion defines a pair of pivot holes in two opposite sidewalls thereof for receiving a pivot to connect the locking device to the bodies of the lamp cover.

6. The LED lamp as claimed in claim 2, wherein each pivot portion defines a receiving hole and the upper end portion of each branch is rotatably received in the receiving hole of a corresponding pivot portion.

7. The LED lamp as claimed in claim 3, wherein the tabs of the supporting pole are arranged in a line along an axial direction of the supporting pole.

8. The LED lamp as claimed in claim 6, wherein the fins extend radially and outwardly from the outer sidewall of the lamp cover opposing the LED modules.

9. An LED lamp, comprising:

a lamp cover comprising a plurality of bodies each having an end portion connecting with each other;

a plurality of fins attached to an outer sidewall of each of the bodies of the lamp cover;

a plurality of LED modules attached to an inner sidewall of each of the bodies of the lamp cover; and a locking device having a first portion pivotably mounted to the end portions of the bodies of the lamp cover, a second portion rotatably connected to the bodies of the lamp cover;

wherein the bodies of the lamp cover are movable relative to the locking device and a distance between every two adjacent bodies of the lamp cover is changeable when the second portion of the locking device is moved along the first portion of the locking device, and wherein an illumination angle of light emitted by the LED modules of the LED lamp is changeable via adjusting the distance between every two adjacent bodies of the lamp cover;

wherein the first portion of the locking device comprises a supporting pole extending in the end portions of the bodies of the lamp cover and the second portion of the locking device comprises a plurality of branches pivotably mounted to the bodies of the lamp cover and the supporting pole, the end portions of the bodies being pivotably connected to the supporting pole; and wherein the supporting pole comprises a plurality of tabs extending therefrom and one end portion of each branch is supported by a corresponding tab when the locking device is moved to a desired position.

10. The LED lamp as claimed in claim 9, wherein the locking device further comprises a ring connecting the branches and the supporting pole, the ring with the branches being movable along the supporting pole to move the locking device to the desired position.

11. An LED lamp comprising:

a plurality of sector-shaped bodies having a plurality of apexes adjacent to each other;

at least an LED module attached to a lower surface of a corresponding body;

a supporting pole having an upper end to which the apexes of the sector-shaped bodies are pivotably attached;

a plurality of branches each having an upper end pivotably attached to the lower face of the corresponding body and a lower end attached to the supporting pole;

wherein a position of the lower end of each branch is adjustable along the supporting pole to be fixed at a desired position thereby to adjust an illuminating area and an illumination intensity of the LED lamp; and wherein the supporting pole has a plurality of tabs projecting outwardly therefrom, the tabs being resiliently moved into the supporting pole when a depressing force acts on the tabs, and wherein when the lower end of each branch is fixed at the desired position, the lower end of each branch is supported by a corresponding tab.

* * * * *